US005468173A

United States Patent [19]

Winton, III

[11] Patent Number: 5,468,173

[45] Date of Patent: Nov. 21, 1995

[54] AUTOMATIC DEBURRING MACHINE

[76] Inventor: George R. Winton, III, 242 Ashbourne Tr., Lawrenceville, Ga. 30243

[21] Appl. No.: 129,953

[22] Filed: Sep. 30, 1993

[51] Int. Cl.[6] ..... B24B 9/00; B24B 7/06

[52] U.S. Cl. ..... 451/59; 451/211; 451/241

[58] Field of Search ..... 51/90, 120, 119, 51/76 R, 328, 102; 451/211, 271, 270, 184, 59, 241

[56] References Cited

U.S. PATENT DOCUMENTS

| | | | |
|---|---|---|---|
| 919,054 | 4/1909 | Milne, Jr. | 51/76 R |
| 3,271,909 | 9/1966 | Rutt et al. | 51/76 R |
| 3,468,642 | 9/1969 | Burns | 51/297 |
| 3,872,627 | 3/1975 | Schuster | 51/135 R |
| 4,615,146 | 10/1986 | Tassoni | 51/90 |
| 4,646,473 | 3/1987 | Hundebol | 51/90 |
| 4,704,823 | 11/1987 | Steinback | 51/110 |
| 4,835,913 | 6/1989 | Blanton | 51/76 R |
| 5,274,962 | 1/1994 | Hundebol | 51/90 |

FOREIGN PATENT DOCUMENTS

| | | | |
|---|---|---|---|
| 0817795 | 9/1937 | France | 51/90 |

OTHER PUBLICATIONS

Timesavers, Model 337–6RP Rotary Polisher brochure, Aug. 1988.

*Primary Examiner*—Robert A. Rose

[57] ABSTRACT

An automatic deburring machine used for the edge deburring of hard components. This automatic deburring machine, utilizing several abrasive flap wheels, causes the wheels to penetrate the internal and external edges by combining the three axis motion of the abrasive flap wheels with the two axis motion of the work piece transporting system. This multi-axis motion will significantly deburr the internal and external edges with three hundred and sixty degrees of symmetry.

1 Claim, 9 Drawing Sheets

AUTOMATIC DEBURRING MACHINE

BACKGROUND—FIELD OF INVENTION

The present invention relates to an automated deburring machine for deburring external and internal edges of hard components; e.g., machined or fabricated sheet metal parts.

BACKGROUND—DESCRIPTION OF PRIOR ART

It has been a standard in the metal working industry to break sharp edges on fabricated and machined parts. To accomplish this level of workmanship, the manufacturers of hard components, such as sheet metal parts, have relied mainly on manual hand tools, vertical belt sanders, bench mounted rotating abrasive wheels, horizontal-rotating-abrasive wheels, and rotary polish sanders.

Although the manual hand tool approach produces adequately deburred edges on piece parts, it is the labor intensity of the task that makes this approach economically unattractive. In addition, the planer surfaces of a sheet metal part, which often requires abrading, are not efficiently abraded with manual hand tools. Moreover, the use of hand tools tends to produce non-homogeneous deburred finishes. A similar argument can be made for the motorized abrasive wheel most often found in metal working shops mounted to a bench or to an independent stand.

The conveyorized vertical belt sander abrades the sheet's top surface but fails to deburr the internal and most external edges of a piece part; see U.S. Pat. No. 3,872,627 which was issued to Gordon L. Schuster on Mar. 25, 1975. It is well acknowledged in the fabrication of sheet metal parts that as a sheet metal part passes under a rotating vertical abrasive belt via a horizontal conveyor, the tangent plane of the vertical belt in contact with the piece part is unable to significantly penetrate below the sheet's top surface into an internal pocket; i.e., unable to sufficiently affect a sharp edge that is partly located along the adjacent vertical surface. Furthermore, given the constant relative motion between the vertical belt and the sheet metal part, it becomes difficult to deburr internal or external edges with 360 degrees of homogeneous symmetry.

The horizontal-rotating-abrasive wheel technique is a light deburring process that will abrade the top surface of a piece part but fails to remove significant surface scratches; see U.S. Pat. No. 4,704,823 which was issued to Clarence I. Steinback on Nov. 10, 1987. In addition, U.S. Pat. No. 4,704,823 attempts to radius internal and external edges by forcing a horizontal-rotating-flexible-abrasive media below the abraded top horizontal surface of the piece part. After close inspection of this process, one can conclude that the large-rotating-abrasive wheel is unable to significantly penetrate an edge to an extent sufficient for edge deburring. Furthermore, as the abrasive media rotates in its plane of motion, the centripetal force of the wheel will tend to prevent the abrasive media from penetrating an internal or external edge of the piece part; thus eliminating any chance of significant edge deburring.

The rotary polisher sanding technique rotates several abrasive brushes about a static vertical axis; see Rotary Polisher (RP) manufactured by Timesavers, Minneapolis, Minn. This technique, primarily found in the wood working industry, will round the edges of a piece part and abrade its top surface. The rotary polisher machine utilities a large-horizontal-rotating carousel to transport several vertical-rotating-abrasive wheels. With the vertical axis of the horizontal rotating assembly being fixed, the outer most diameter established by the rotating assembly must approach the span of the of conveyor belt. This is necessary in order to homogeneously process a part that also approaches the span of the conveyor belt. In order to process a piece part that is significantly shorter than the width of the conveyor belt, the rotary polisher machine incorporates a vacuum-conveyor system to secure the piece parts in place. The addition of the vacuum system is a significant disadvantage with respect to added cost to the end user.

OBJECTS AND ADVANTAGES

Accordingly, several objects and advantages of my invention are:

(a) to adequately deburr internal and external edges of hard components by means of an automated process;

(b) to cause significant internal and external edge deburring by directing an abrasive wheel to penetrate below the top surface by utilizing the centripetal force imposed on the abrasive wheel;

(c) to produce a homogeneous deburred part by means of an automated process;

(d) to deburr parts with the longest linear dimension significantly less than the width of the conveyor belt without utilizing a vacuum conveyor system to secure the parts in place.

Further objects and advantages are to significantly abrade the top surface for such reasons as general cosmetic appearance and or for possible paint preparation. Still further objects and advantages will become apparent from a consideration of the ensuing description and drawings.

DRAWING FIGURES

Figure 1:
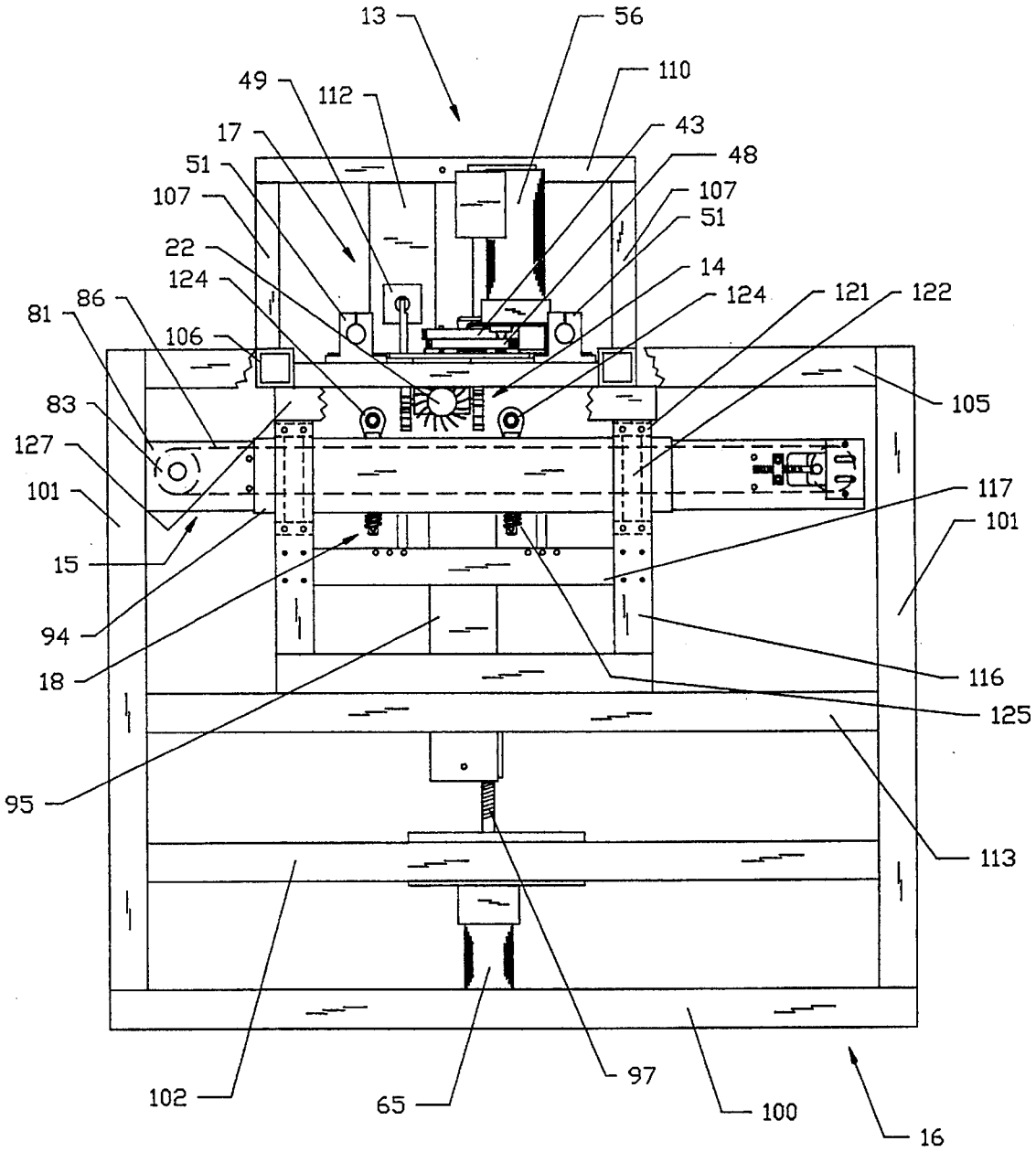
FIG. 1 shows the main assemblies of the invented deburring machine and their relative position to one another.

| Reference Numerals in Drawings | |
|---|---|
| 13 inventive machine | 14 wheel assembly |
| 15 conveyor assembly | 16 frame assembly |
| 17 gantry assembly | 18 work holder assembly |
| 21 housing | 22 abrasive wheel |
| 23 wheel shaft | 24 bevel gear 25 miter gear |
| 26 vertical wheel drive shaft | 27 assembly drive shaft |

-continued

| Reference Numerals in Drawings | |
|---|---|
| 28 assembly bearing | 29 wheel bearing |
| 30 assembly shaft housing | 31 assembly top plate |
| 32 wheel axis bearing | 33 assembly shaft collar |
| 41 wheel pulley | 42 wheel motor pulley |
| 43 wheel belt | 44 motor wheel bracket |
| 45 gantry base | 46 assembly pulley |
| 47 assembly motor pulley | 48 assembly belt |
| 49 pneumatic cylinder | 50 assembly motor bracket |
| 51 shaft hanger | 54 rod end mount |
| 55 wheel motor | 56 assembly motor |
| 57 gantry guide block | 58 gantry guide shaft |
| 65 lift motor | 66 lift support plate |
| 67 lift motor plate | 81 conveyor rail |
| 82 conveyor rib | 83 drive roller |
| 84 conveyor motor | 85 follow roller |
| 86 conveyor belt | 87 conveyor platen |
| 90 adjusting block | 91 locking plate |
| 92 motor support bracket | 93 support bar |
| 94 horizontal beam | 95 vertical beam |
| 96 lower support bar | 97 power screw |
| 98 power nut | 100 lower rail |
| 101 vertical support | 102 mid rail |
| 103 outer coolant rib | 104 conveyor support rib |
| 105 upper rail | 106 gantry rib |
| 107 gantry vertical support | 108 gantry rail |
| 109 gantry support plates | 110 gantry top rail |
| 111 lower rib | 112 cylinder base |
| 113 mid upper rail | 114 coolant guide rail |
| 115 coolant support rib | 116 vertical guide beam |
| 117 roller base | 118 roller arm |
| 119 vertical roller support | 120 roller guide plate |
| 121 rod support | 122 vertical guide rod |
| 123 contact roller | 124 rod eye |
| 125 compression spring | 126 pin |
| 127 top horizontal rail | 128 horizontal coolant rail |
| | 129 alignment bolt |

DESCRIPTION—FIGS. 1–5, 8, and 9

With initial reference to FIG. 1, the inventive machine 13 is shown. Inventive machine 13 comprises of two wheel assemblies 14 (one shown), a conveyor assembly 15, a supporting frame 16, a gantry assembly 17, and a work holder assembly 18.

Figure 5:
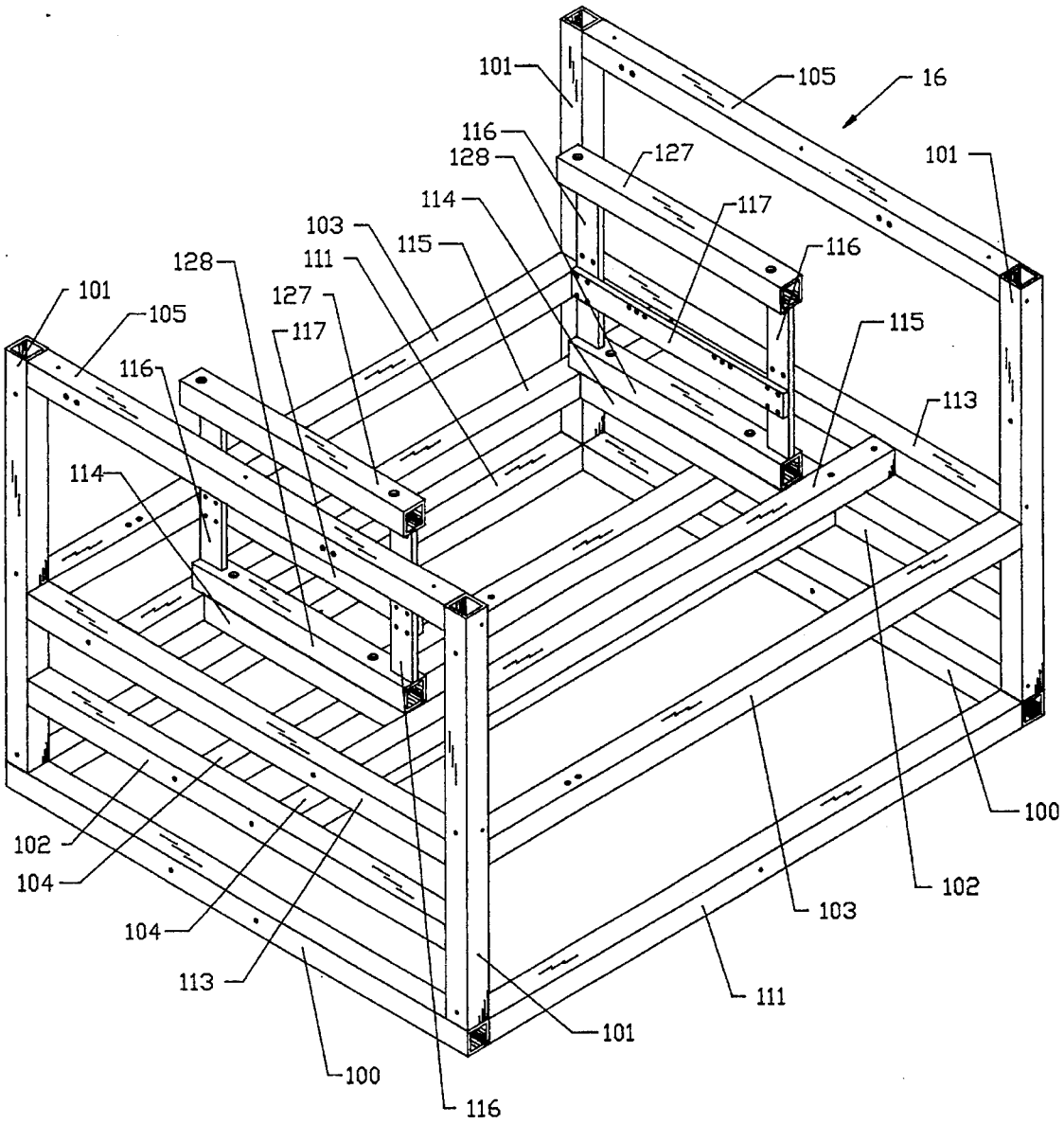
FIG. 5 shows an assembled view of the supporting frame for the preferred embodiment.

With reference to FIG. 5, frame assembly 16 consists of two lower rails 100 which are fastened to two lower ribs 111. Lower rails 100 are fastened at the ends to four vertical supports 101 and two mid rails 102 are each fastened at the ends to vertical supports 101. Two conveyor support ribs 104 are fastened to mid rails 102. Two mid upper rails 113 are fastened at the ends to the vertical supports 101. Fastened to the mid upper rails 113 are two coolant support ribs 115. Fastened to coolant support ribs 115 are two coolant guide rails 114. Two upper rails 105 are fastened at the ends to vertical beams 101. Fastened the vertical supports 101 in the same horizontal plane as the mid upper rails 113 are two outer coolant ribs 103.

Figure 3:
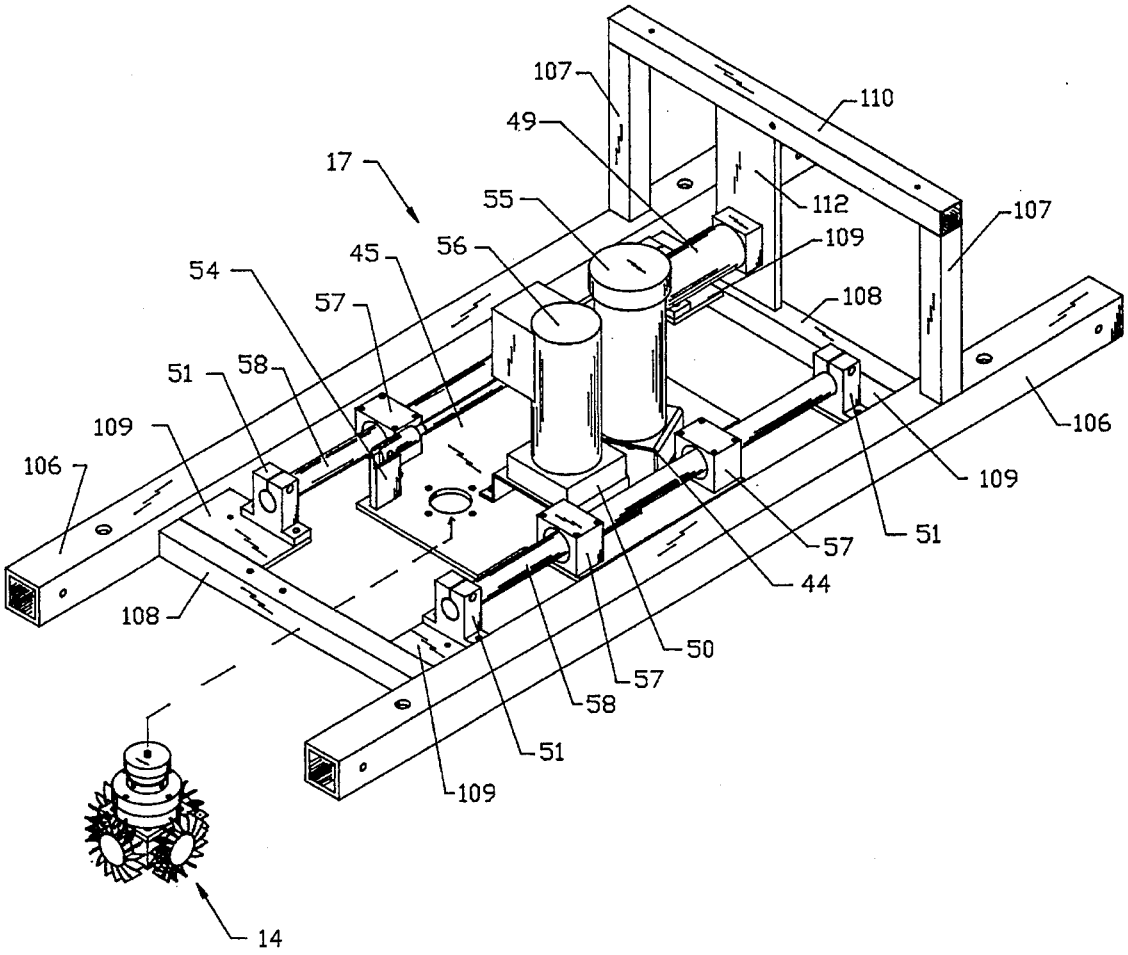
FIG. 3 shows the gantry assembly relative to its supporting frame and how it relates to the wheel assembly.

With reference to FIGS. 1 and 3, two gantry ribs 106 are fastened to two upper rails 105. Attached to the gantry ribs 106 are two gantry vertical supports 107. Two gantry rails 108 are fastened to gantry ribs 106. Four gantry support plates 109 are fastened to gantry rails 108 and gantry ribs 106. A gantry top rail 110 is fastened at the ends to gantry vertical supports 107. A cylinder base 112 is fastened to one gantry rail 108 and to gantry top rail 110.

Figure 8:
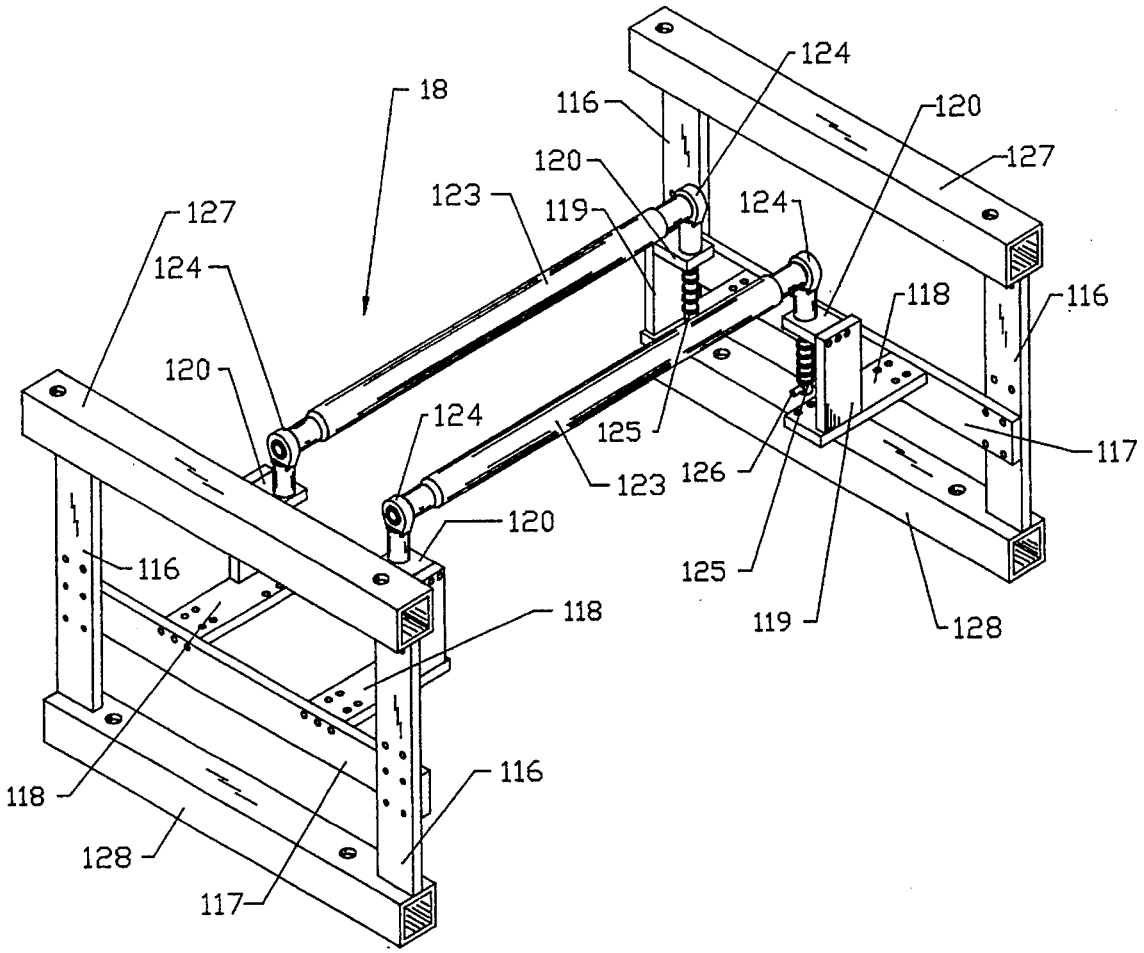
FIG. 8 shows the contact rollers in position relative to the supporting frame.

The following description is used twice in the preferred embodiment. Therefore, a detailed description of one will be exemplary for both. With reference to FIGS. 1, 5, and 8, a horizontal coolant rail 128 is fastened to the coolant guide rail 114. Fastened to horizontal coolant rail 128 are two vertical guide beams 116. Fastened between vertical guide beams 116 is a roller base 117. Connecting both vertical guide beams 116 at the top is a top horizontal rail 127. Top horizontal rail 127 is fastened to both gantry ribs 106.

The following description is used twice in the preferred embodiment. Therefore, a detailed description of one will be exemplary for both. With reference to FIGS. 1 and 8, a contact roller 123 comprises of a long round bar with an external rubber coating. The ends of contact roller 123 are free of all rubber coating. Locating the ends of contact roller 123 are two rod eyes 124. Each rod eye 124 has a hole perpendicular to its centerline axis located opposite the end supporting the contact roller 123. A pin 126 is pressed into this hole. Each rod eye 124 passes through a roller guide plate 120. Located below each roller guide plate 120 and around rod eye 124 and resting on pin 126 is a compression spring 125.

The following description is used twice in the preferred embodiment. Therefore, a detailed description of one will be exemplary for both. With reference to FIGS. 1, 5, and 8, two roller arms 118 are fastened to a roller base 117. Roller arms 118 are fastened to two vertical roller supports 119. Supports 119 are fastened to the two roller guide plates 120.

Figure 4:
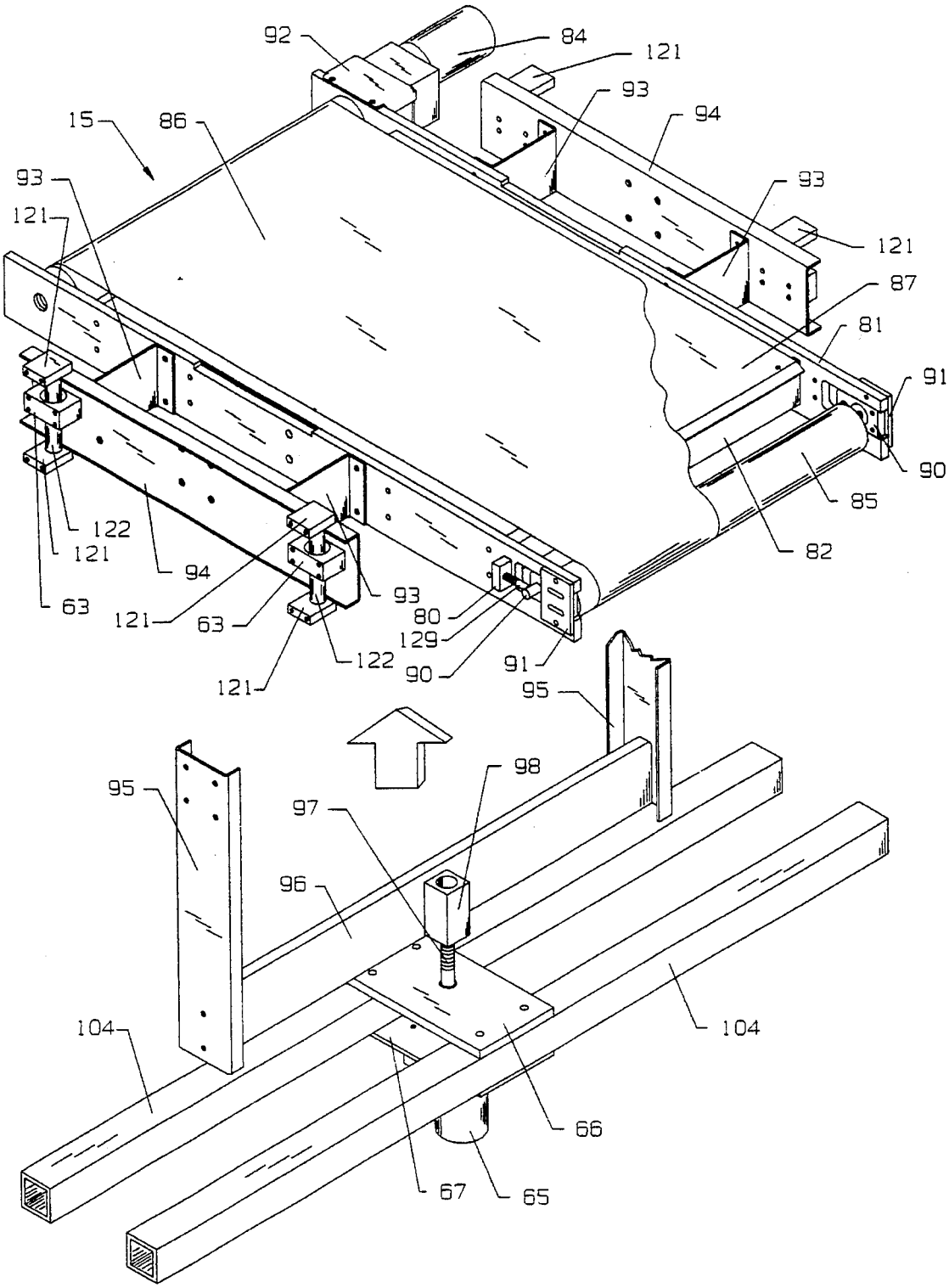
FIG. 4 shows an assembled view of the conveyor and how it relates to the lift mechanism.

The following description is used four times in the preferred embodiment. Therefore, a detailed description of one will be exemplary for both. With reference to FIGS. 1 and 4, two rod supports 121 are fastened to vertical guide beam 116. Located between the two rod supports 121 is a vertical guide rod 122.

Figure 2:
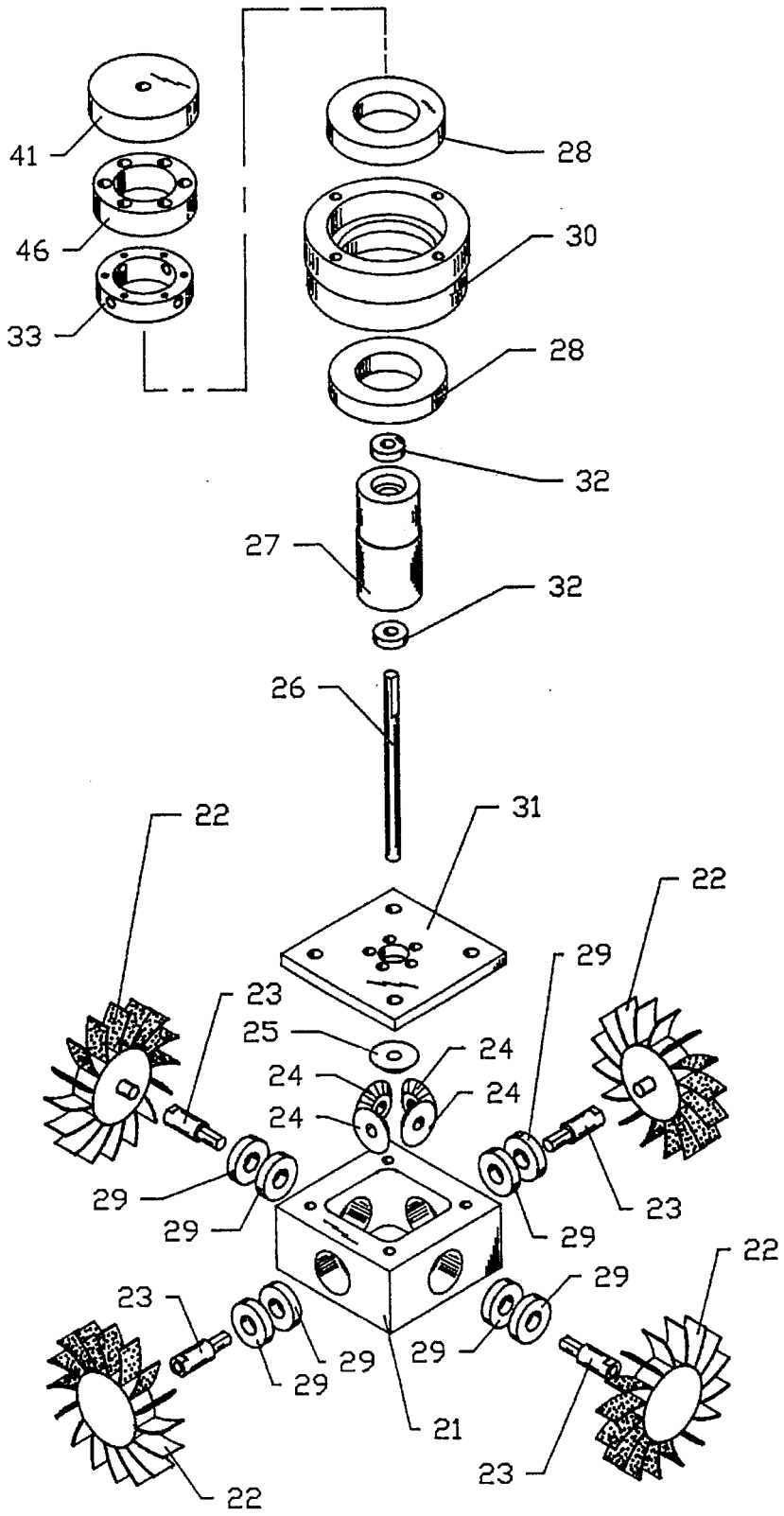
FIG. 2 shows an exploded view of the abrasive wheel assembly.
Figure 6:
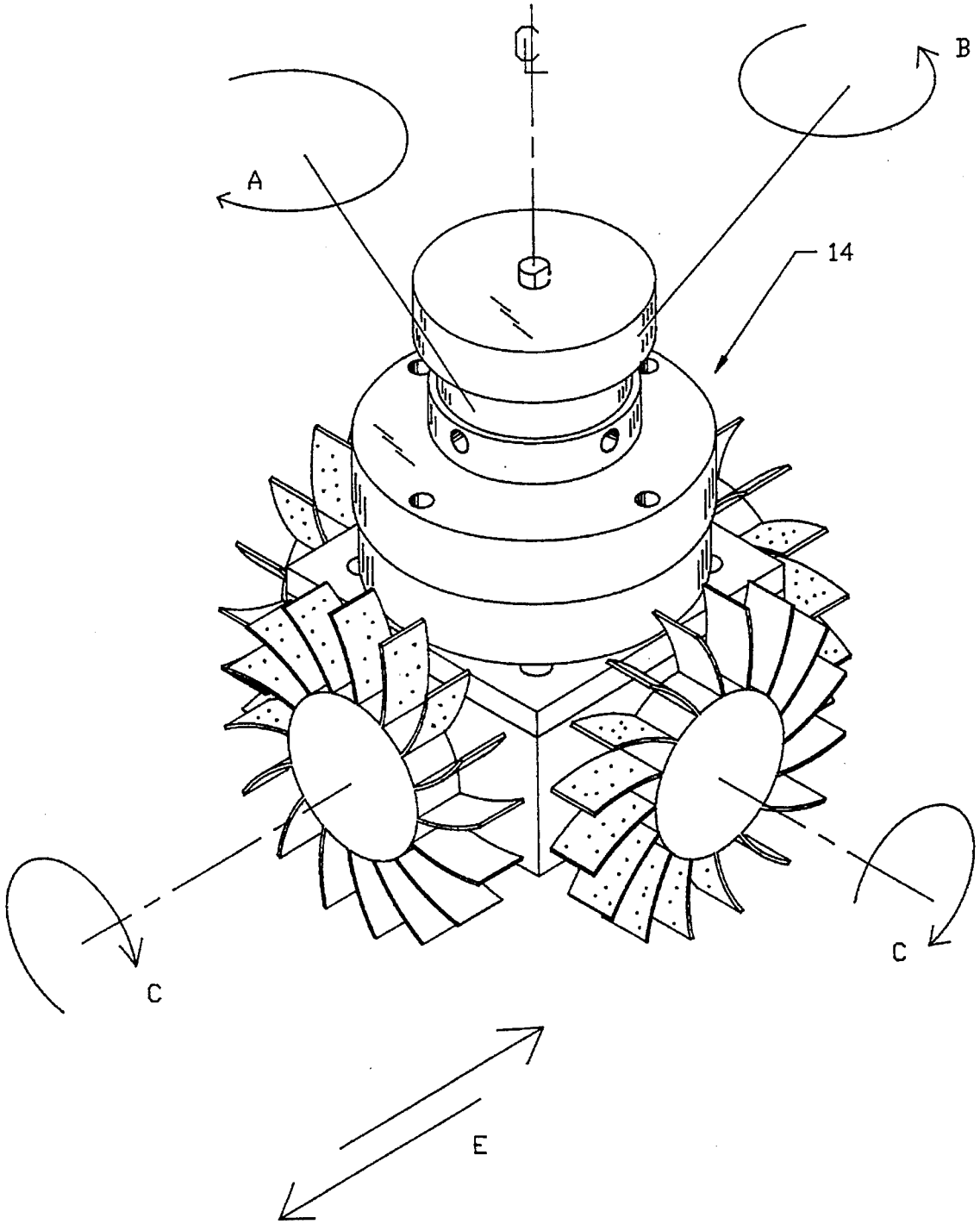
FIG. 6 shows an isometric view of the abrasive wheel assembly.

The following description of a wheel assembly 14 is used twice in the preferred embodiment. Therefore, a detailed description of one will be exemplary for both. With reference to FIGS. 2 and 6, wheel assembly 14 comprises of a housing 21 which supports four abrasive wheels 22 by means of four wheel shafts 23. Abrasive flap wheels 22 used in the preferred embodiment are similar in construction to that described by U.S. Pat. No. 3,468,642 which was issued to Russell W. Burns on Sep. 23, 1969. All wheel shafts 23 are located within the same plane ninety degrees apart. Each wheel shaft 23 is supported by two wheel bearings 29. Wheel bearings 29 are supported by housing 21. Each wheel shaft is attached to a bevel gear 24. Four bevel gears 24 are connected to a miter gear 25. A vertical wheel drive shaft 26 is fastened to miter gear 25. Supporting the wheel drive shaft 26 are two wheel axis bearings 32. Wheel axis bearings 32 are held captive within an assembly drive shaft 27. Assembly drive shaft 27 is held captive by two assembly beatings 28. Assembly bearings 28 are held captive by an assembly shaft housing 30. Assembly drive shaft 27 is also fastened to an assembly top plate 31. Assembly top plate 31 is fastened to housing 21. Assembly drive shaft 27 is held captive by an assembly shaft collar 33. A wheel pulley 41 is fastened to the top of vertical wheel drive shaft 26. Attached to assembly collar is an assembly pulley 46.

Figure 9:
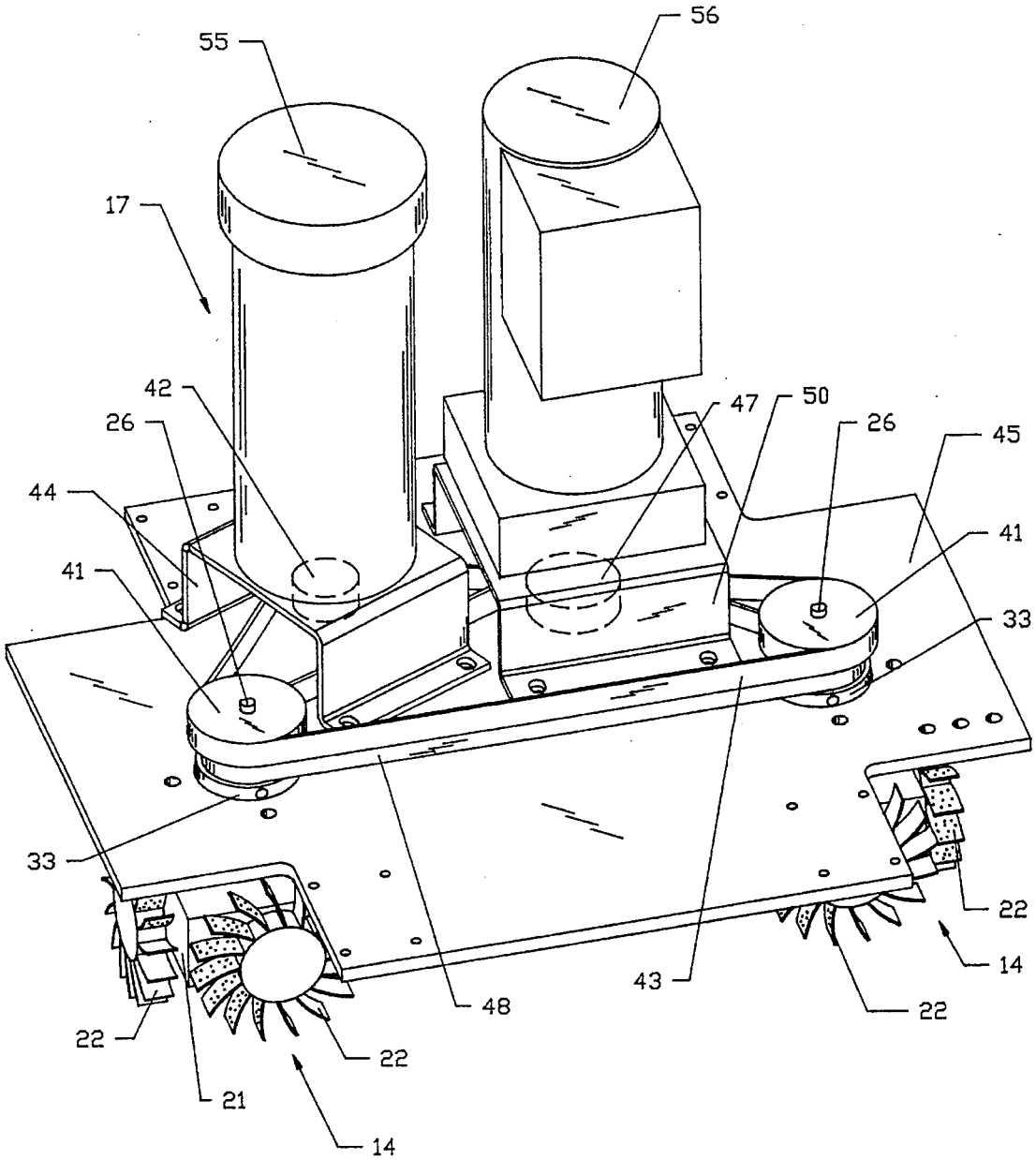
FIG. 9 show the relative position between the gantry assembly and the wheel assemblies.

With reference to FIGS. 2, 3, and 9, both assembly shaft housings 30 are fastened to a gantry base 45. The wheel pulleys 41 are connected to a wheel motor pulley 42 by means of a wheel belt 43. Pulley 42 is fastened to a wheel motor 55. Wheel motor 55 is supported by a motor wheel bracket 44 and bracket 44 is fastened to gantry base 45. Similarly, assembly pulleys 46 are connected to an assembly motor pulley 47 by means of an assembly belt 48. Pulley 47 is fastened to an assembly motor 56. Supporting assembly motor 56 is an assembly motor bracket 50 and bracket 50 is fastened to gantry base 45. Gantry base 45 is fastened to four gantry guide blocks 57. A pair of guide blocks 57 locates one of two gantry guide shafts 58. A shaft hangers 51, one mounted to each gantry support plate 109, supports one end of each gantry guide shaft 58.

Connected to one end of a pneumatic cylinder 49 is a rod end mount 54 and to the other end is cylinder base 112. Rod end mount 54 is fastened to gantry base 45.

With reference to FIGS. 1 and 4, the length of the conveyor assembly 15 is determined by the length of two conveyor rails 81. The width of the conveyor assembly 15 is determined by five conveyor ribs 82 (one shown). At one end of the conveyor assembly 15 is a drive roller 83. Drive roller 83 is connected directly to a conveyor motor 84 by means of a commonly found coupling. Conveyor motor 84 is supported by a motor support bracket 92. Bracket 92 is fastened to one conveyor rail 81. A conveyor belt 86, comprised of an external rubber surface, is placed around drive roller 83 and around a follow roller 85. Conveyor belt 86 is also supported by a conveyor platen 87. Conveyor platen 87 is fastened to conveyor ribs 82. Each roller, 83 and 85, is supported by two commonly found roller bearings. The bearings for the drive roller 83 are held captive by conveyor rails 81. The bearings for the follower roller 85 are held captive by two adjusting blocks 90. Adjusting blocks 90 are located within an obround slot machined into the ends of each conveyor rail 81. Adjusting blocks 90 are fastened to conveyor rails 81 by two locking plates 91. Locking plates 91 have slotted through holes that are aligned with the tapped holes in adjusting blocks 90.

The following description is used twice in the preferred embodiment. Therefore, a detailed description of one will be exemplary for both. With further reference to FIGS. 1 and 4, conveyor rail 81 is fastened to two upper support bars 93. Joining the two support bars 93 is a horizontal beam 94. Horizontal beam 94 is fastened to a vertical beam 95.

With further reference to FIGS. 1 and 4, both vertical beams 95 are connected to each other by a lower support bar 96. Lower support bar 96 is fastened to a power nut 98. Power nut 98 is connected to a power screw 97. Screw 97 is connected to a lift motor 65 by means of a commonly found coupling. Power screw 97 is supported by a commonly found thrust washer. The thrust washer is supported by a lift support plate 66. Lift support plate 66 is fastened to both conveyor support ribs 104. Lift motor 65 is fastened to a lift motor plate 67. Lift plate 67 is also fastened to both conveyor support ribs 104.

OPERATION—FIGS. 1–9

With reference to FIGS. 1, 4, and 8, machine 13 is operated by first placing a planer work piece, no greater in width than that established by conveyor ribs 82, on conveyor belt 86. By applying electrical power to conveyor motor 84, the work piece is transported under the contact rollers 123. While the work piece is being transported through the deburring area, the deburring area being established as below and between the contact rollers 123, two events are simultaneously taking place.

Firstly, with reference to FIGS. 1 and 8, the work piece is held firmly in place against conveyor assembly 15 by means of work holders 123. Work holders 123 are pulled downward by rod eyes 124. Forcing each rod eye 124 downward are four compression springs 125. All four compression springs 125 apply a force between pins 126 and rod supports 121. This force is transmitted to frame assembly 16 by means off our vertical roller supports 119 and four roller bases 117.

Secondly, with reference to FIGS. 1, 2, 8, and 9, as the work piece passes through the deburring area, pneumatic cylinder 49 is simultaneously forcing gantry base 45 to oscillate back and forth on gantry guide shafts 58 (FIG. 6, linear direction "E") over the width of conveyor belt 86. Simultaneously, by applying electrical power to wheel motor 55, wheel motor 55 causes wheel belt 43 to rotate vertical drive shafts 26 (FIG. 6, rotational direction "B"). With reference to FIGS. 2 and 6, each drive shaft 26 then forces four wheel shafts 23 to rotate by means of miter gear 25 and four bevel gears 24. Each wheel shaft 23 then causes four abrasive wheels 22 to rotate in a vertical plane perpendicular to the top most horizontal upper flight established by conveyor belt 86 (FIG. 6, rotational direction "C"). By simultaneously applying electrical power to assembly motor 56, assembly motor 56 turns both assembly shafts 27 by means of assembly belt 48. Each assembly shaft 27 then rotates one assembly top plate 31. Each top plate 31 then rotates one housing 21. By rotating both housings 21 simultaneously, all eight abrasive wheels 22 rotate about a second axis perpendicular to the top most horizontal upper flight established by conveyor belt 86 (FIG. 6, rotational direction "A").

By applying electrical power to conveyor lift motor 65, motor 65 turns power screw 97. Power screw 97 then cause power nut 98 to rise in a vertical direction. Power nut 98 then causes lower support bar 96 to push upward on vertical beams 95. Vertical beams 95 then causes horizontal beams 94 to push upward on upper support bars 93. Upper support bars 93 then raise conveyor rails 81. As conveyor rails 81, conveyor ribs 82, lift support plate 66, and thus conveyor belt 86 is directed upward toward the wheel assemblies 14, the top most horizontal plane of the planer work piece will approach the lower most horizontal plane established by the tangents of the abrasive wheels 22. Applying additional electrical power to lift motor 65 causes the tips of abrasive wheels 22 to deflect off the top most surface of the planer work piece.

With reference to FIGS. 3, 5, 6, and 7, oscillating gantry assembly 17 and rotating wheel assemblies 14 causes the abrasive wheels 22 to move toward a sharp edge on the work piece located within the deburring area. When the tips of abrasive wheels 22 are not in contact with the work piece and the work piece is located within the deburring area, the centripetal force of the rotating wheels 22 (FIG. 6, rotational axis "C") causes the tips of the wheels 22 to thrust outward below the top most surface of the work piece (FIG. 7B, linear dimension "D"). As the simultaneous three axis motion of both abrasive assemblies continue, the abrasive wheels 22 will eventually come in contact with more edges of the work piece. This contact, between the abrasive wheel and a sharp edge, then removes material from the edges of the work piece; an edge is established as the intersection of two adjacent surfaces. As assembly motor 56 continues to rotate housings 21 and pneumatic cylinder 49 continues to oscillate the gantry assembly, new edges will come in contact with the tips of the abrasive wheels 22. Additional edges will come in contact with the tips of the abrasive wheels 22 as the conveyor belt 86 simultaneously transports the work piece through the deburring area.

Figures 7A, 7B:
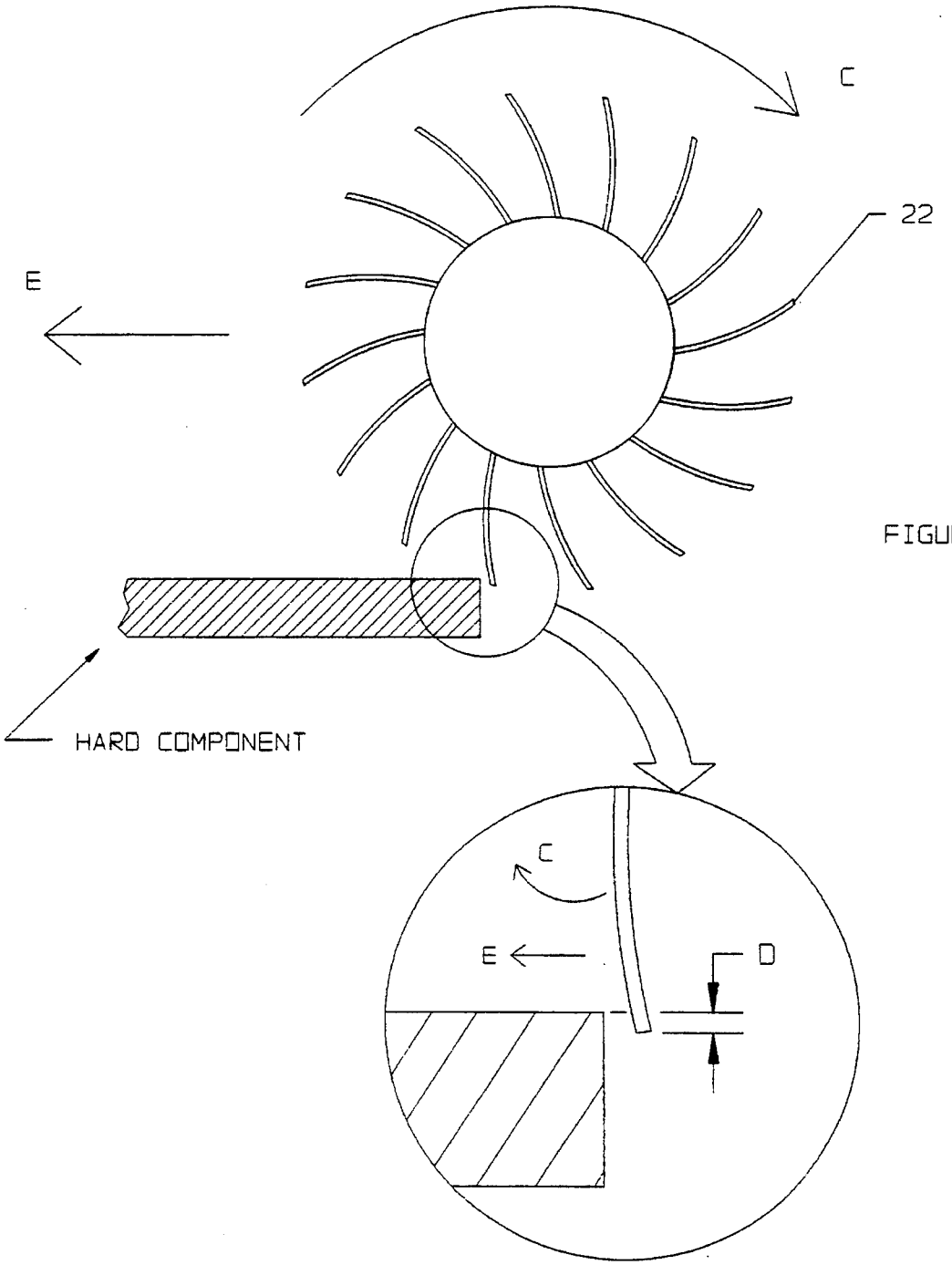
FIG. 7A shows a side view of the interaction between an abrasive wheel and a hard component just before the moment of edge deburring.
FIG. 7B shows an enlarged view of FIG. 7A.

The combined simultaneous motion of the following results in all top most edges of a work piece, external and internal, being deburred in an automated and homogeneous fashion:

a) the linear oscillations of gantry assembly 17 and hence abrasive wheels 22 (FIGS. 6 and 7A, linear direction "E");

b) the rotational motion of abrasive wheels 22 about their own axis (FIGS. 6 and 7A, rotational direction "C");

c) the rotational motion of each wheel assembly 14 and hence each abrasive wheel 22 about an axis perpendicular to the top most horizontal upper flight established by conveyor belt 86 (FIG. 6, rotational direction "A");

d) the linear motion of conveyor belt 86.

The amount of material removed from an edge can be controlled by varying one or all of the following: the speed of conveyor belt 86, the abrasive grit size of abrasive wheel 22, the penetration of flap wheels 22 in relation to the top most horizontal plane of the work piece (FIG. 7B, dimension "d"), the rotational speed of abrasive wheels 22 about their own axis (FIG. 7A, rotational direction "C"), the rotation speed of the abrasive wheels 22 about an axis perpendicular to the top most horizontal upper flight established by conveyor belt 86.

With reference to FIGS. 1 and 4, the alignment of conveyor belt 86 between rollers 83 and 85 is adjusted by turning alignment bolts 129. The alignment bolts 129 locate roller 85 by adjusting the distance between alignment bolt bases 80 and adjusting blocks 90.

The preferred embodiment described above operates in a dry atmosphere, i.e., no cutting lubrication. An alternative to the preferred embodiment would incorporate a coolant system. This system would allow for a wet deburring environment. In addition to extending the life of the abrasive wheels 22, the coolant would suppress the abrasive grit and the dust like particles removed from the hard component. With reference to FIG. 5, a coolant pan would rest on frame members 103 and 115. With the addition of a fluid pump and two hoses, a liquid could be circulated from the coolant pan to the abrasive heads and back to the coolant pan by means of gravity. With the addition of the coolant system, the construction of the abrasive wheels 22 would require a higher resistance to water like coolants.

CONCLUSION, RAMIFICATIONS, AND SCOPE OF INVENTION

Thus the reader will see that the three axis simultaneous motion of the wheel assemblies (14) combined with the two axis motion of the conveyor assembly (15) will cause the tips of the abrasive wheels (22) to successfully deburr all internal and external edges of a work piece. This is accomplished in part by directing the tips of the abrasive wheels (22) radially outward below the top surface of the work piece and thus enabling the deburring mechanism to take place. This full radial extension of the abrasive wheels is only possible when the abrasive wheel is not being deflected by the top most horizontal surface of the work piece. The three axis motion of the abrasive heads coupled with the two axis motion of the conveyor assembly (15) allows the tips of the abrasive wheels (22) to deburr all edges with three hundred and sixty degrees of symmetry. In addition to significantly deburring the edges of a work piece, the abrasive wheels (22) will abrade the top most horizontal surface of the work piece.

While the above description contains many specificities, these should not be construed as limitations on the scope of the invention, but rather as an exemplification of one preferred embodiment thereof. Many other variation are possible. for example the abrasive wheel assembly described in the preferred embodiment uses four abrasive wheels (22) per wheel assembly (14). A variation would employ a machine that used two abrasive wheels (22) per wheel assembly (14). These abrasive wheels would be mounted in a similar assembly as that shown by FIG. 2; the wheels would be mounted one hundred and eighty degrees apart. Moreover, in place of the two wheel assemblies (14) shown in the preferred embodiment, a different number of wheel assemblies (other than two) could be used. This would shorten the stroke of the pneumatic cylinder (49) and thus possibly reduce the cycle time of the deburring process.

Accordingly, the scope of the invention should be determined not by the embodiment illustrated, but by the appended claims and their legal equivalents.

I claim:

1. An apparatus for deburring a substantially flat surface of a workpiece, said apparatus comprising:

conveyor means for moving the workpiece in a first linear direction, the workpiece contacting a surface of said conveyor means;

a plurality of abrasive wheel means;

wheel assembly means for supporting said plurality of abrasive wheel means, said wheel assembly means having a first axis of rotation perpendicular to said surface of said conveyor means;

said plurality of abrasive wheel means each having a respective second axis of rotation extending radially from said first axis of rotation and parallel to said surface of said conveyor means;

said wheel assembly means simultaneously rotating each one of said plurality of abrasive wheel means about respective said second axes of rotation as said wheel assembly means rotates about said first axis of rotation and oscillating in a second linear direction perpendicular to said first linear direction and parallel to said surface of said conveyor means;

said plurality of abrasive wheel means contacting the substantially flat surfaces of the workpiece as the workpiece moves in said first linear direction;

each of said wheel assembly means comprising;

a housing for supporting each of said plurality of abrasive wheel means wherein said housing is supported by a first end of an assembly drive shaft; and said housing comprising;

a plurality of wheel shafts, each one of said plurality of wheel shafts disposed parallel to said surface of said conveyor means and each one of said plurality of wheel shafts rotates about a respective corresponding axis of rotation of said plurality of abrasive wheel means;

one end of said plurality of wheel shafts being attached to a respective one of said plurality of abrasive wheel means;

a plurality of bevel gears, each one of said plurality of bevel gears is attached to a second end of a respective corresponding said wheel shaft;

a miter gear meshed with each one of said plurality of bevel gears;

a wheel drive shaft disposed perpendicular to said surface of said conveyor means and first end of said wheel drive shaft is fastened to said miter gear;

a first wheel pulley fastened to a second end of said wheel drive shaft opposite said first end; and a second wheel pulley attached at a second end of said assembly drive shaft opposite said first end;

said apparatus further comprising;

a first wheel belt contacting each of said first wheel pulleys;

a second wheel belt contacting each of said second wheel pulleys;

first motor means for rotating said first wheel pulleys;

and second motor means for rotating said second wheel pulleys.

* * * * *